United States Patent [19]

Chen et al.

[11] Patent Number: 4,897,887

[45] Date of Patent: Feb. 6, 1990

[54] PREKNOTTED ADJUSTABLE NECKTIE

[76] Inventors: Jiann-Jong Chen; Ching-Hwa Chen, both of 21, Alley 21, Lane 244, Sec. 5, Yen-Ping North Road, Taipei, Taiwan

[21] Appl. No.: 238,731

[22] Filed: Aug. 31, 1988

[51] Int. Cl.[4] ..... A41D 25/02; A41D 25/08

[52] U.S. Cl. ..... 2/150; 2/152 A; 2/153

[58] Field of Search ..... 2/150, 152 R, 153, 144; 24/49 K, 49 S

[56] References Cited

U.S. PATENT DOCUMENTS

| | | | |
|---|---|---|---|
| 2,247,184 | 6/1941 | Burfening . | |
| 2,294,508 | 9/1942 | Minor . | |
| 2,553,437 | 5/1951 | Burke | 2/150 |
| 3,127,618 | 4/1964 | Roach . | |
| 3,284,807 | 11/1966 | Espino . | |
| 3,363,264 | 1/1968 | Mathison . | |
| 3,820,166 | 6/1974 | Gouner | 2/153 |
| 4,024,585 | 5/1977 | Girdler . | |
| 4,337,539 | 7/1982 | Najarian . | |
| 4,513,453 | 4/1985 | Chen et al. . | |
| 4,615,048 | 10/1986 | Gasser | 2/153 |
| 4,656,672 | 4/1987 | Lande | 2/150 |
| 4,710,982 | 12/1987 | Lande | 2/150 |
| 4,771,481 | 9/1988 | Gasser | 2/150 |

*Primary Examiner*—H. Hampton Hunter

*Attorney, Agent, or Firm*—Wegner & Bretschneider

[57] ABSTRACT

A preknotted adjustable necktie comprises a knot former having, an inner body (62) and an outer body (61), an inner tie member with a zipper (3), an outer tie member (5), and a rivet (63). The knot former serves forming and control functions, and the inner tie member is sandwiched between the inner and outer bodies thereof, with a pulling button of the zipper slider on the inner tie member secured to the inner and outer bodies of the knot former and to the outer tie member by a rivet. The outer tie member is tied into a fixed knot over the knot former. By means of the presence of a pair of leaf springs (622) on the inner body, the position of the tie knot and the zipper slider can be adjusted freely and retained in the position set.

8 Claims, 2 Drawing Sheets

FIG. 7A
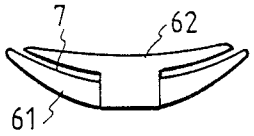
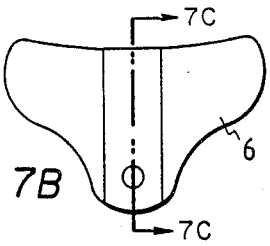
FIG. 7B
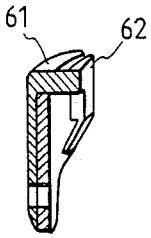
FIG. 7C
FIG. 8A
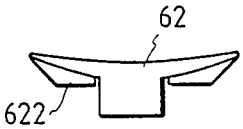
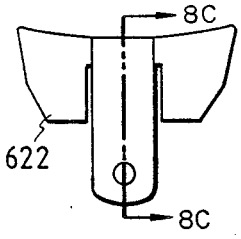
FIG. 8B
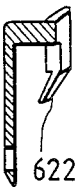
FIG. 8C
FIG. 9A
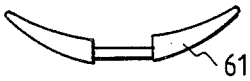
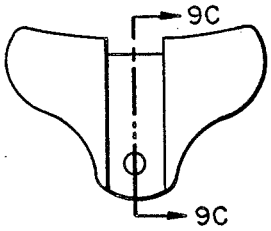
FIG. 9B
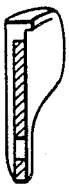
FIG. 9C

PREKNOTTED ADJUSTABLE NECKTIE

Neckties are a major part of attire for men all over the world. When wearing a necktie, it is necessary to tie a knot. For men having ample time, it is enjoyable to wear a necktie and have the knot tied carefully. But for men who are busy, it is a great burden to wear a necktie so far as the time for tying the knot is concerned. However, according to customs, courtesies, and special rules (such as those for members of the armed forces), wearing a necktie is necessary. The preknotted necktie of the present invention is so designed as to address these conditions.

Conventional preknotted neckties are of many types. Among others, there are neckties which use a zipper as control means. These neckties are either inconvenient to use or uncomfortable to wear, and besides, it is difficult to have the tie knot properly fixed yet such that the tie knot is easily slid out of position. The zipper starts sliding very easily if a stopper is not provided therein; but if a stopper is used with the zipper, the pull button that controls the sliding of the zipper has to be in different positions when the button is used for pulling and when it is at rest. The button, when used for pulling, must be pulled away from the zip fastener. For a necktie, however, the button must be hidden in the back or it will spoil the appearance of the necktie. But if the pull button is hidden in the back, it will press against the portion externally of the wearer's throat, which makes the wearer feel very uncomforatable.

The necktie of the present invention is intended to address the above-mentioned disadvantages. The present invention provides a preknotted adjustable necktie comprising an inner tie member which comprises a loop portion to surround a users neck in use and a portion depending from said loop portion, the junction between said loop portion and said depending portion incorporating a zip fastener having an adjustment slider whereby the size of the loop portion may be adjusted, a knot former comprising an inner body and an outer body connected together, with the inner tie member passing between the inner body and the outer body and the slider of the zip fastener fixed to the knot former, and an outer tie member fastened to said knot former, arranged as a knot over the knot former and depending therefrom, such that the position of the knot former on the inner tie member may be varied to tighten and to loosen the loop portion.

In a preferred embodiment of the present invention, the knot former on which the outer tie member may be tied into a knot is divided into an inner body and an outer body which connect together. The two bodies are fitted one over the other with a control slot provided therebetween for the inner tie member sliding therein, a pair of leaf springs being provided on depending portions of the inner body. In addition to increase resistance to sliding movement, said leaf springs serve to produce a resistance to downward sliding movement which is much greater than that to upward pulling movement so as to obtain a necktie which is characterised in that the tie knot is easy to pull up but difficult to slide down.

The structure of a preferred necktie according to the present invention will now be described by way of illustration with reference to the accompanying drawings in which:

FIG. 7A shows the knot former in front elevation view;

FIG. 7B shows the knot former of FIG. 7A in top view;

FIG. 7C shows the cross-sectional view taken along the line 7C—7C of FIG. 7B;

FIG. 8A shows the inner body of the knot former in front elevation view;

FIG. 8B shows the inner body of the knot former of FIG. 8A in top view;

FIG. 8C is a cross-sectional view taken along the line 8C—8C of FIG. 8B;

FIG. 9A shows the outer body of the knot former in front elevation view;

FIG. 9B shows the outer body of the knot former of FIG. 9A in top view; and

FIG. 9C is a cross-sectional view taken along the line 9C—9C of FIG. 9B.

FIG. 1 shows the appearance of a necktie according to the present invention, including an outer tie member 5 made of fabric material used conventionally for making neckties. The size of the tie loop portion 2 of an inner tie member, can be adjusted to match an individual wearer's neck size.

Figure 2:
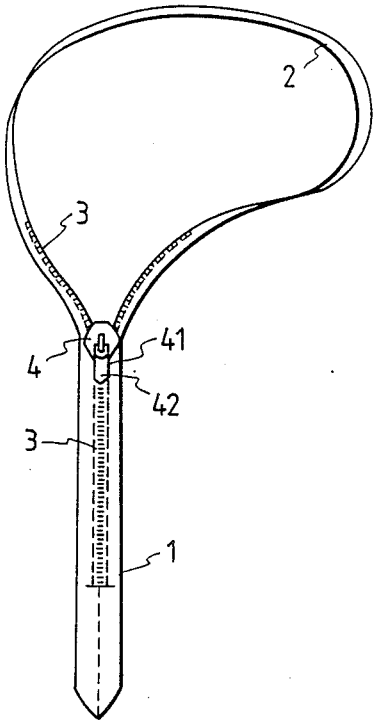
FIG. 2 shows the structure of the inner tie member of the necktie.

FIG. 2 shows the structure of the inner tie member 1 which is a strip made of the same fabric as the outer tie member 5, the upper portion thereof encircling to become a closed loop 2 which is provided with a zipper 3 on the lower portion of its inner edge. The opening and closing of the zipper is controlled by a slider 4, said slider being provided with a pull button 41 for pulling the slider as in the case of conventional sliders. The only difference is that no slide pin is provided on the inner side of the pull button so the slider can be slid freely even when the pull button is folded down on to the teeth of the zipper.

Figure 1:
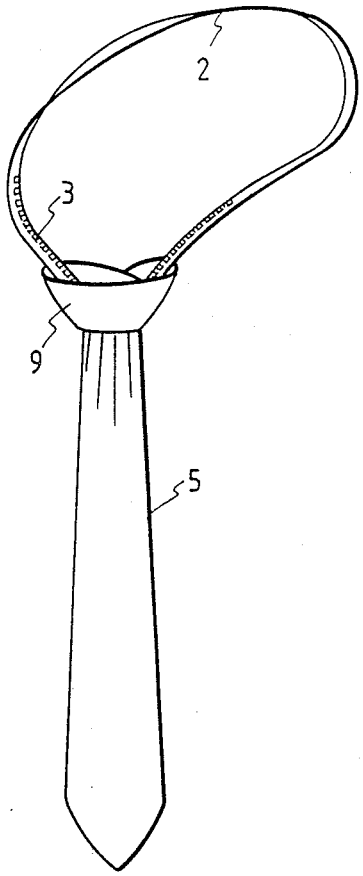
FIG. 1 shows the appearance of a complete necktie according to the present invention.
Figure 3:
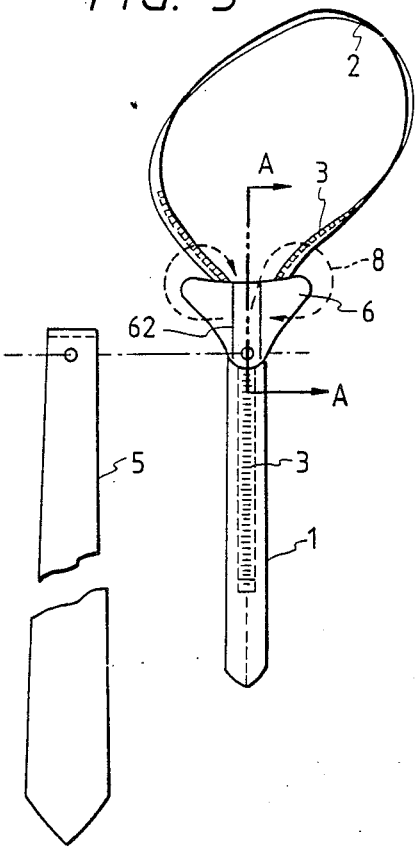
FIG. 3 shows the inner tie member of FIG. 2 when fitted into the knot former.
Figure 4:
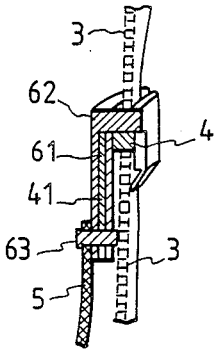
FIG. 4 is a cross-section view taken along line A—A of FIG. 3.
Figure 5:
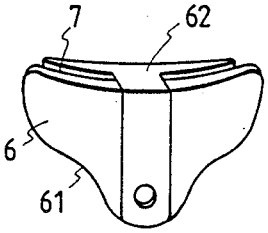
FIG. 5 is a perspective view of the knot former which forms the tie knot into shape and controls the movement of the tie loop.

FIG. 3 shows the inner tie member 1 of FIG. 2 when fitted into the knot former 6, the inner tie member being clamped in a control slot 7 between the inner and outer bodies of the knot former (see FIGS. 5 and 7). A rivet hole 42 is provided on the pull button 41 through which the outer tie member 5, a depending leg 621 of the inner body 62, the outer body 61, and the pull button 41 are sequentially secured together by a rivet 63 (see FIG. 4). Then the outer tie member 5 is tied into a knot over the path indicated by phantom line 8 in the drawing thus to produce a necktie as shown in FIG. 1. Now the wearer can adjust the size of the tie loop 2 by moving the position of the tie knot 9 up and down by pushing the tie knot 9 up or pulling it down with one hand while holding the lower end of the inner tie member 1 (which lies below and is shorter than the outer tie member) with the other hand.

Figure 6:
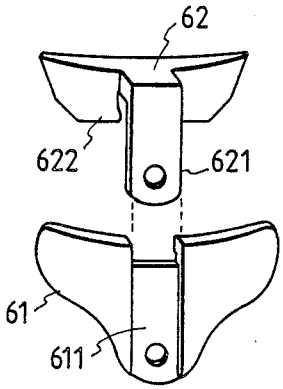
FIG. 6 is an exploded view showing the knot former of FIG. 5.

FIG. 5 is a perspective view of the knot former 6 which forms the tie knot 9 into shape and controls the size of the tie loop 2. FIG. 6 is an exploded view showing the knot former of FIG. 5 which is assembled by fitting the inner body 62 into the outer body 61, an embedding slot 611 being provided in the forward portion centrally of the outer body 61 into which a depending leg 621 of the inner body 62 is fitted. When the inner and outer bodies are fitted together, a small control slot 7 is created therebetween, said slot being of such dimension in width as to allow the bifurcating portion of the inner tie member at the base of the loop portion to pass through on either side of the knot former for the purpose of preventing the inner tie member 2 from becoming twisted when being pulled. Both said inner and outer bodies are made of an elastic plastics material.

FIG. 8 shows the inner body 62 in front elevation view, top view, and the cross-section view taken along the line C—C thereof, respectively, in which a leaf spring 622 is provided on both the left and right sides, respectively, in a depending portion on the inner (front) side of said inner body 62. Normally, the lower edges of said springs are biased against the inner side of the inner tie member 1 (see FIG. 4) to increase resistance to the sliding movement of the knot former. The leaf springs 622 thus slant inwards and downwards such that different resistances will be imposed to the up and down movements of the zipper slider. When the inner tie member is pulled down and the tie knot is pushed up, less resistance will result because the movement is in the same direction in which the leaf springs are slanted. On the contrary, when the tie knot 9 is moved down, increased resistance will result because the movement is against the direction in which the leaf springs depending from the inner body are slanted. In the latter case, while the resistance does not interfere with the deliberate pulling down of the tie knot, it is sufficient to prevent the tie knot 9 from inadvertently sliding down.

We claim:

1. A preknotted adjustable necktie comprising an inner tie member which comprises a loop portion to surround a users neck in use and a portion depending from said loop portion, the junction between said loop portion and said depending portion incorporating a zip fastener having an adjustment slider whereby the size of the loop portion may be adjusted, a knot former comprising an inner body and an outer body connected together, with the inner tie member passing between the inner body and the outer body and the slider of the zip fastener fixed to the knot former, and an outer tie member fastened to said knot former, arranged as a knot over the knot former and depending therefrom, such that the position of the knot former on the inner tie member may be varied to tighten and to loosen the loop portion.

2. A tie as claimed in claim 1, wherein said outer tie member, said knot former and the slider are connected together by a fastener passing through each of them.

3. A tie as claimed in claim 2, wherein the fastener is a rivet.

4. A tie as claimed in claim 1, wherein the knot former inner body has a depending leg and said knot former outer body has a forward facing slot receiving said leg.

5. A tie as claimed in claim 1, wherein the knot former has spring means pinching the inner tie member between the inner and outer bodies of the knot former.

6. A tie as claimed in claim 5, wherein said spring means comprises at least one leaf spring directed inwardly and downwardly (when the tie is in the usual use orientation) so that the knot former is more easily slid up than down.

7. A knot former for use in an adjustable preknotted necktie comprising an inner body and an outer body connectable together to form the knot former, the inner body comprising a pair of oppositely laterally directed wing portions and a depending tongue portion spaced forwardly of the wing portion, the outer body comprising a corresponding pair of oppositely laterally directed wing portions and a downwardly extending slot on the front face of the outer body for receiving said tongue when the inner body is arranged with its wing portions behind said outer body and with said tongue passed over to the front of said outer body.

8. A knot former as claimed in claim 7, wherein said wing portions of the inner body of the outer body are shaped to pinch towards the wing portions of the other of said inner and outer bodies to grip portions of a tie therebetween in use.

* * * * *